US008192101B2

(12) United States Patent
Inoue et al.

(10) Patent No.: US 8,192,101 B2
(45) Date of Patent: Jun. 5, 2012

(54) FOLDER BINDING DEVICE

(75) Inventors: Hideki Inoue, Tokyo (JP); Mitsuru Wakabayashi, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 759 days.

(21) Appl. No.: 12/338,063

(22) Filed: Dec. 18, 2008

(65) Prior Publication Data

US 2009/0169289 A1 Jul. 2, 2009

(30) Foreign Application Priority Data

Dec. 28, 2007 (JP) ..... 2007-340512

(51) Int. Cl.
*B42F 13/36* (2006.01)

(52) U.S. Cl. ..... 402/60; 402/17; 402/8; 412/34

(58) Field of Classification Search ..... 402/77, 402/8, 13–18
See application file for complete search history.

(56) References Cited

U.S. PATENT DOCUMENTS 6,899,504 B2 * 5/2005 Kiyomi ..... 412/34

* cited by examiner

*Primary Examiner* — Edward Tolan
*Assistant Examiner* — Matthew G Katcoff
(74) *Attorney, Agent, or Firm* — The Marbury Law Group PLLC

(57) ABSTRACT

The present invention provides a folder binding device including a binding device main body part in which insertion holes are formed into which binding legs are inserted, operating parts which are attached to the binding device main body part in such a manner as to rotate on rotating projections at end portions thereof as fulcrums, and sliding parts adapted to slide on the binding device main body part, wherein the sliding parts are connected to the operating parts via hinge parts in such a manner as to be activated by rotary operations of the operating parts to slide on the binding device main body part, whereby both fastening and unfastening operations of binding legs are made simple and a stable fastening of the binding legs is enabled.

8 Claims, 13 Drawing Sheets

【Fig.1】
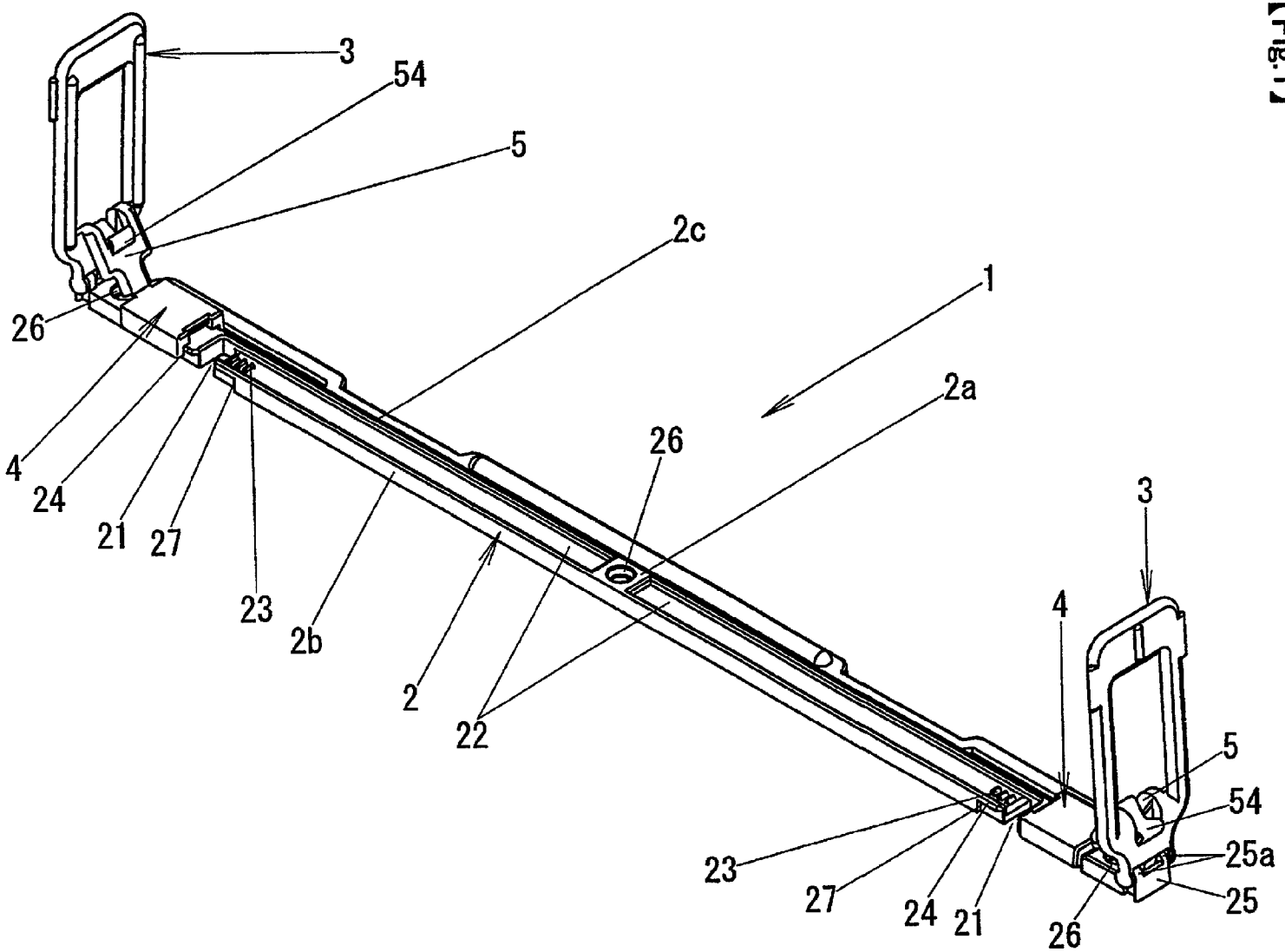

【Fig.2】
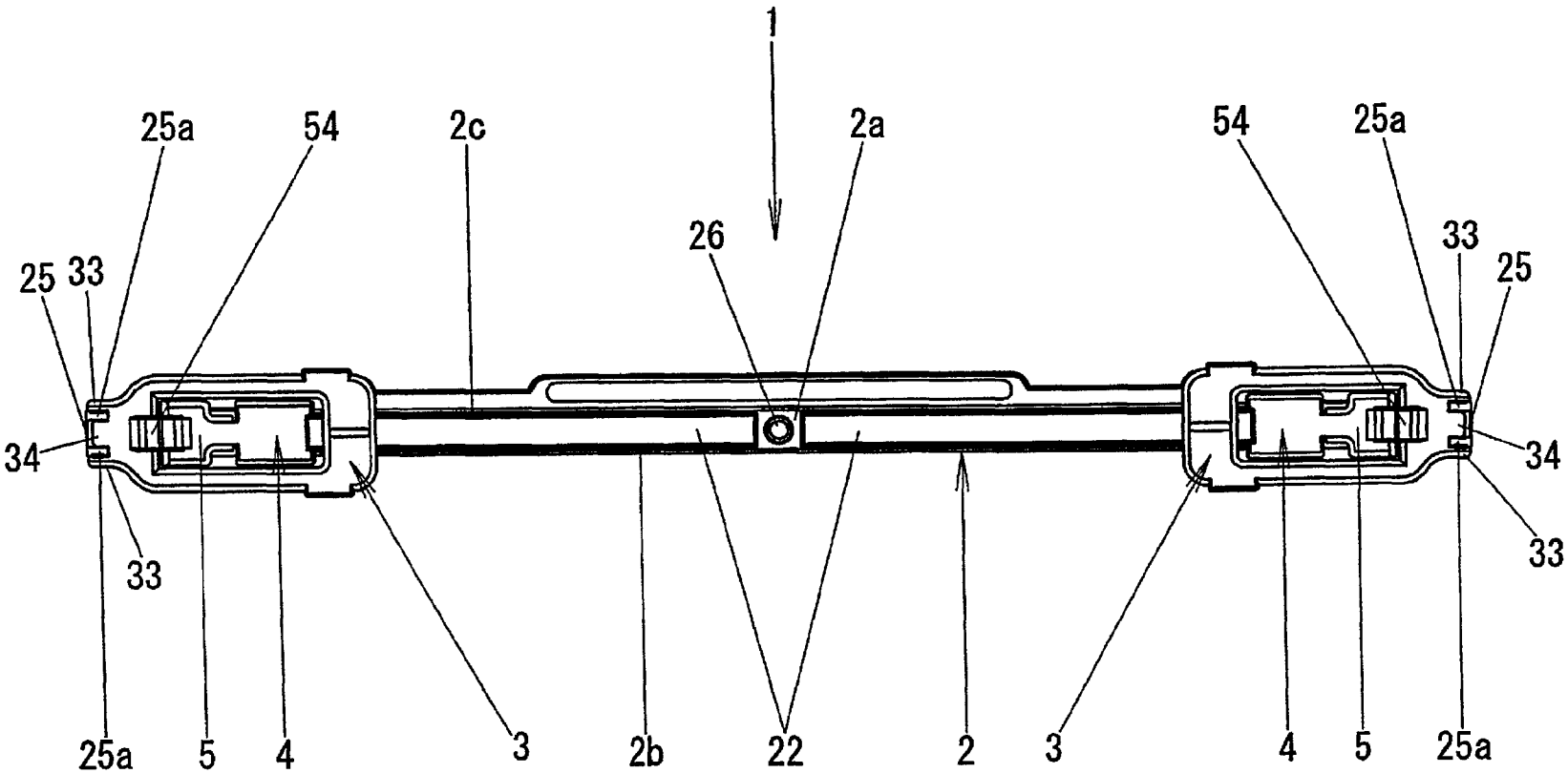

【Fig.3】
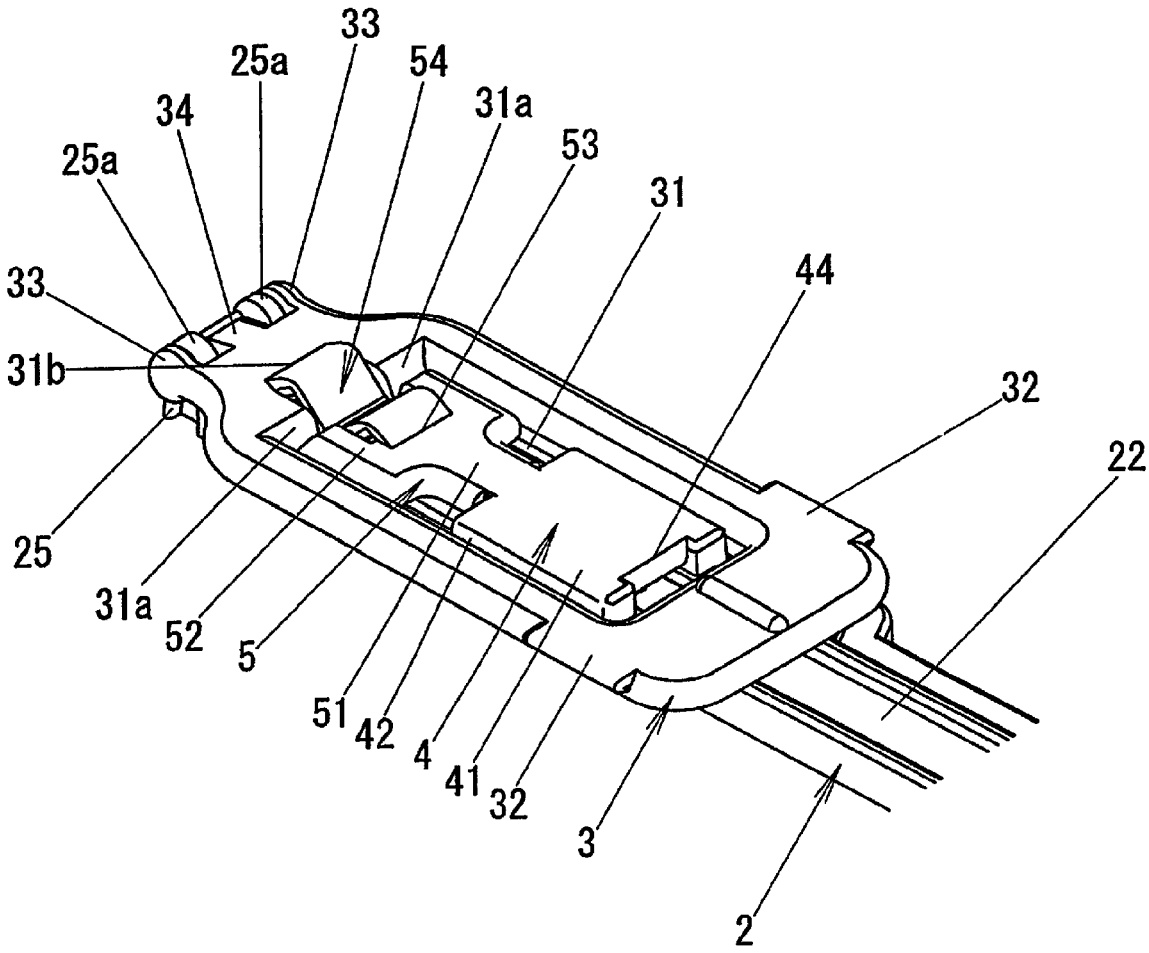

【Fig.4】
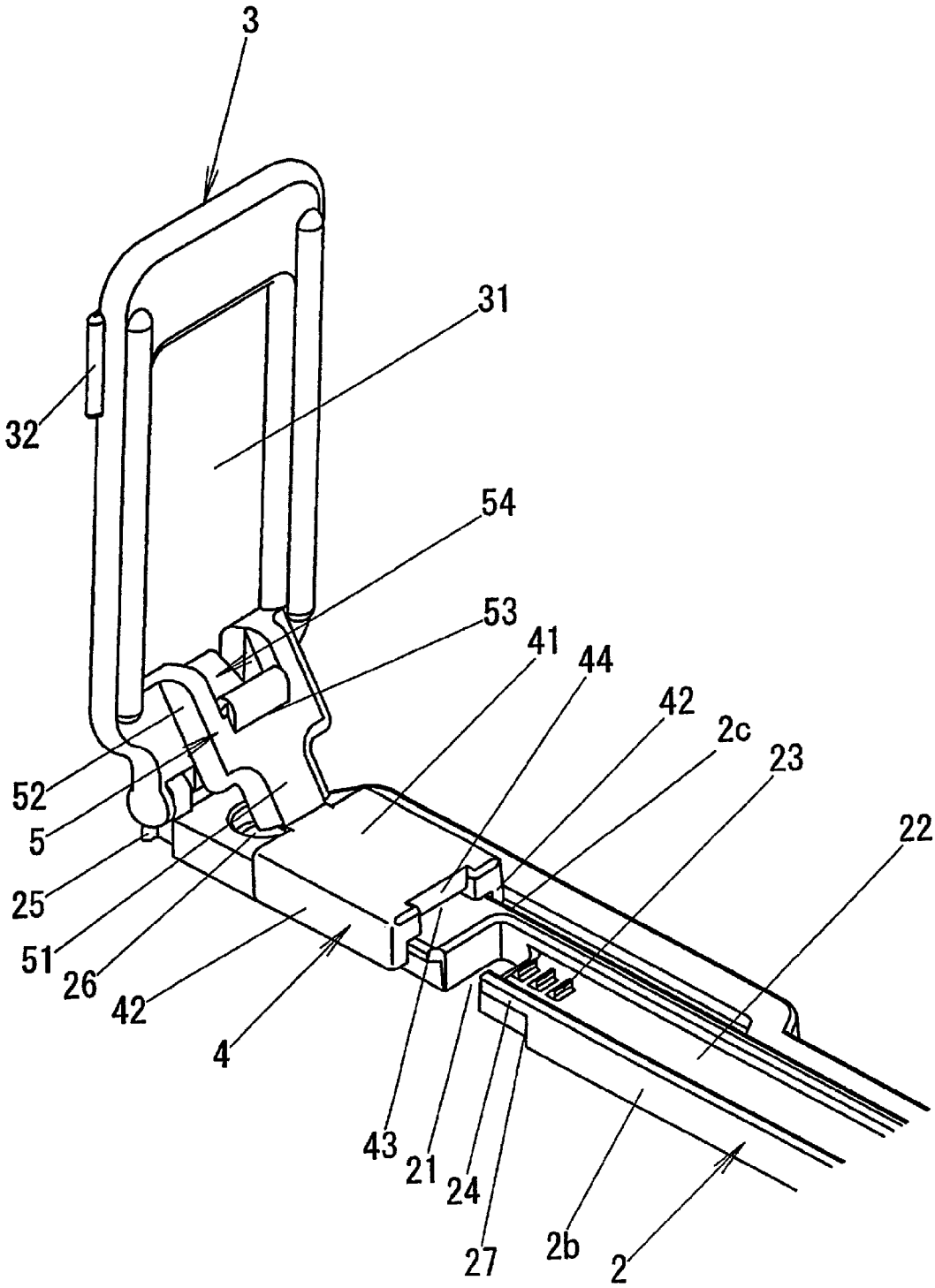

【Fig.5】
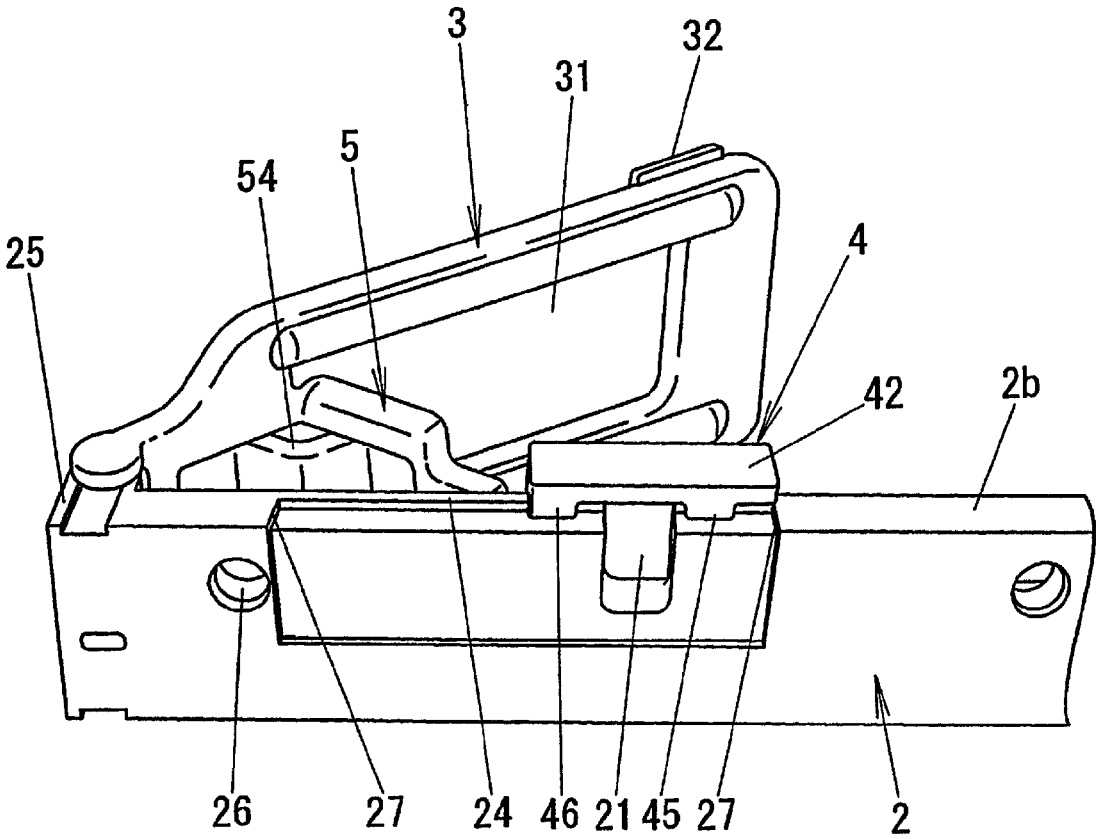

【Fig.6】
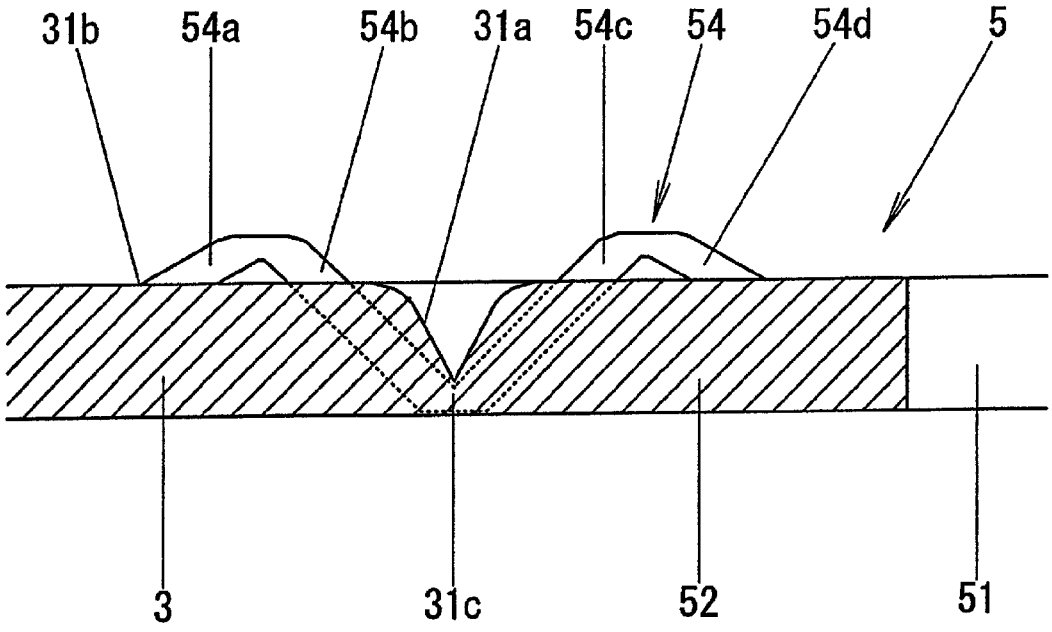

【Fig.7】
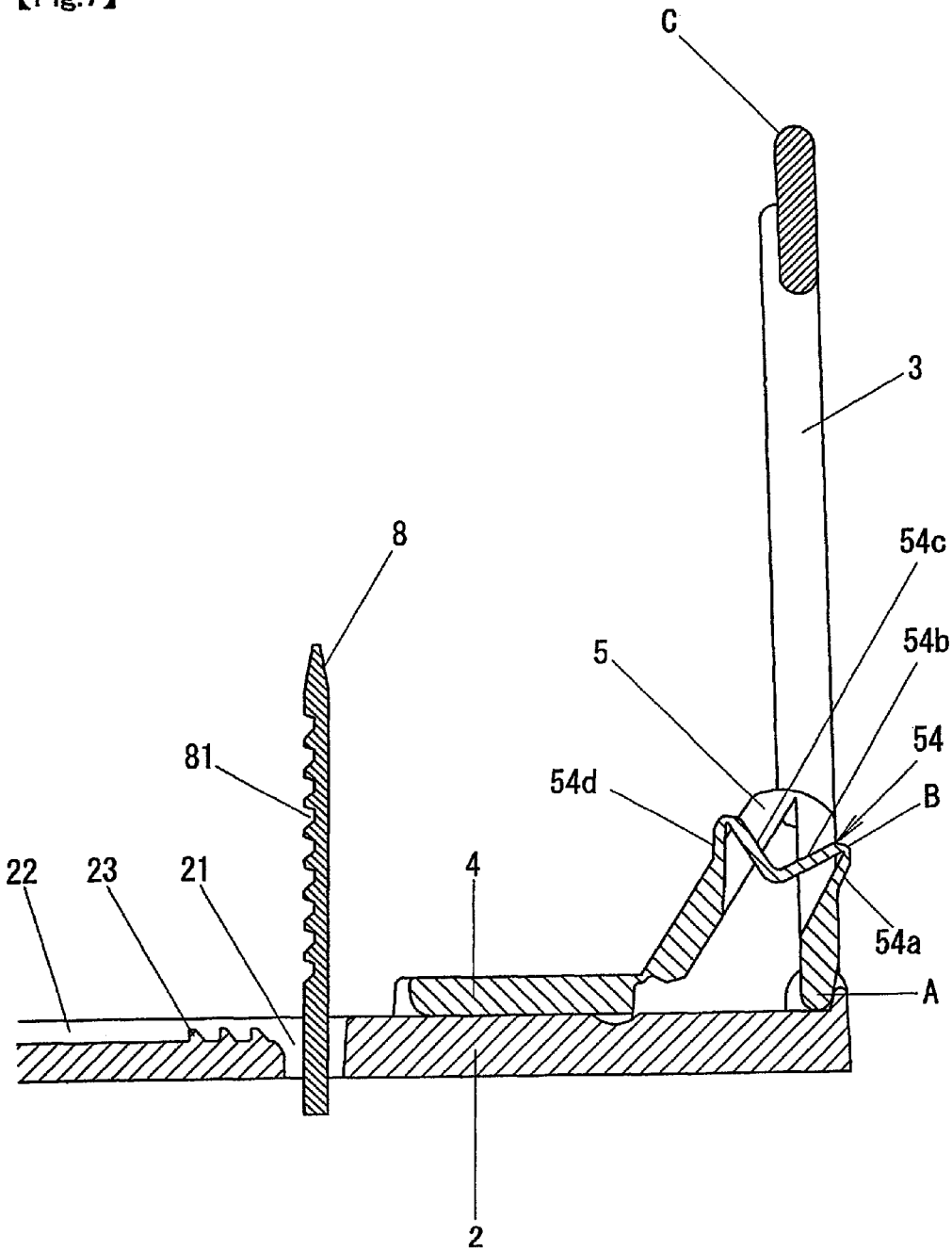

【Fig.8】
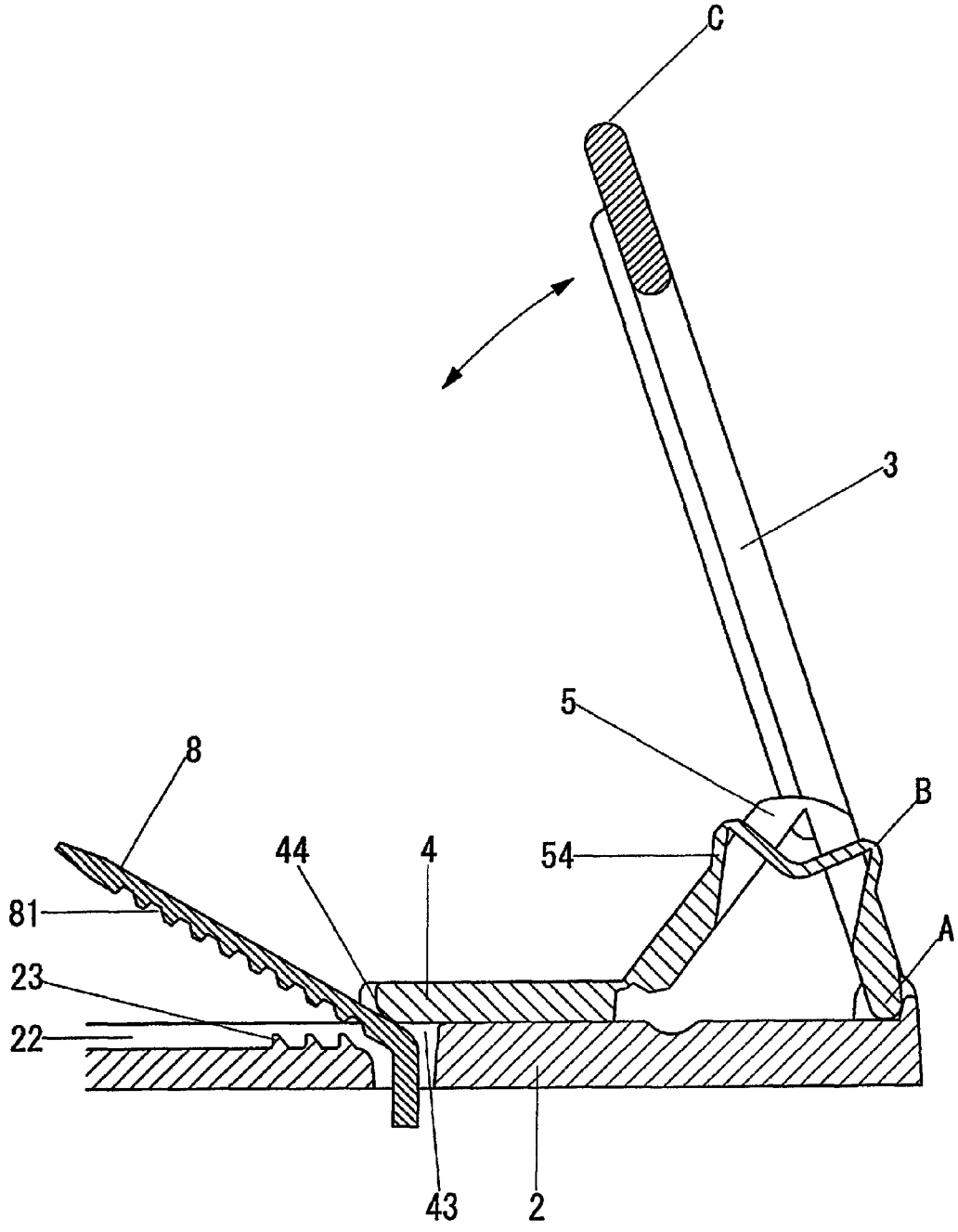

【Fig.9】
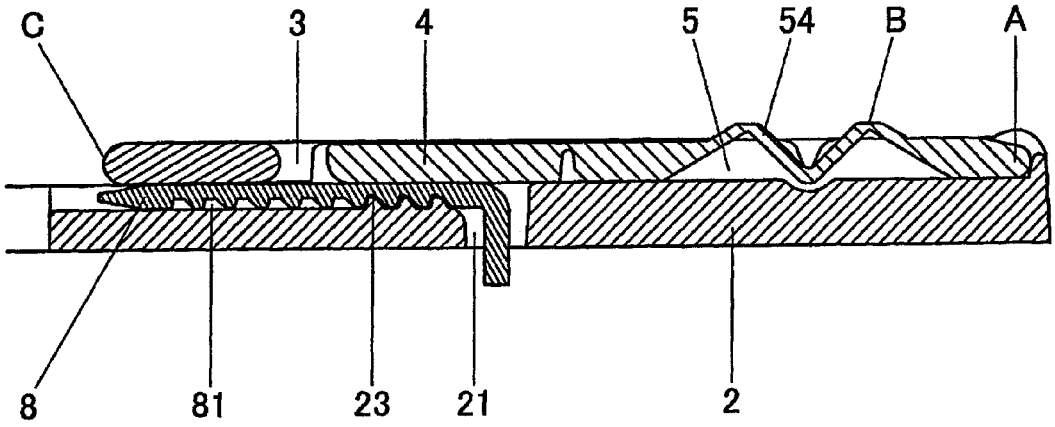

【Fig.10】
(a)
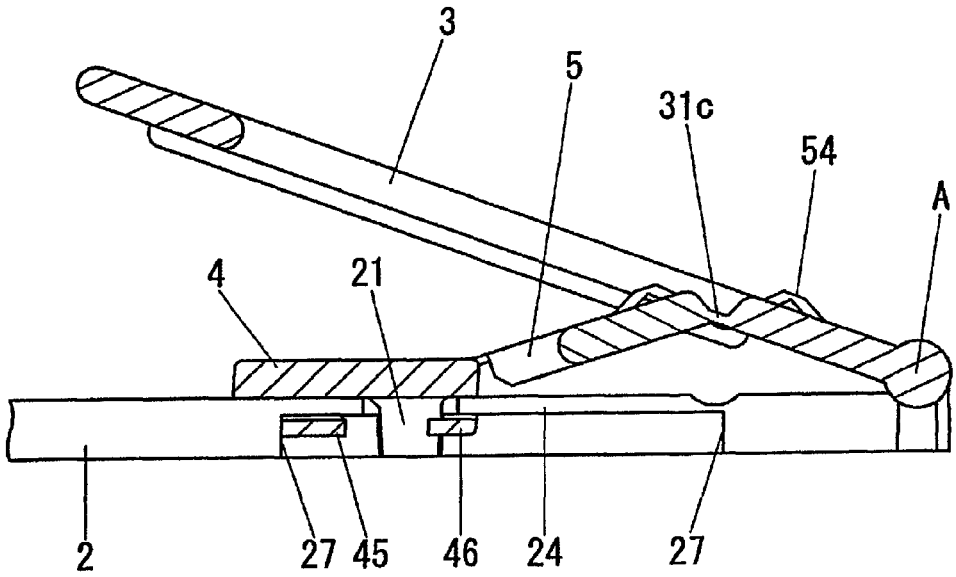
(b)
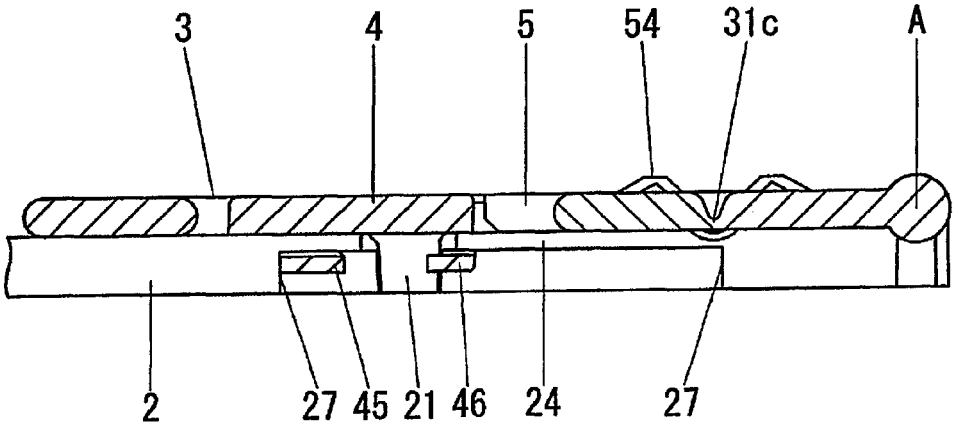

【Fig.11】
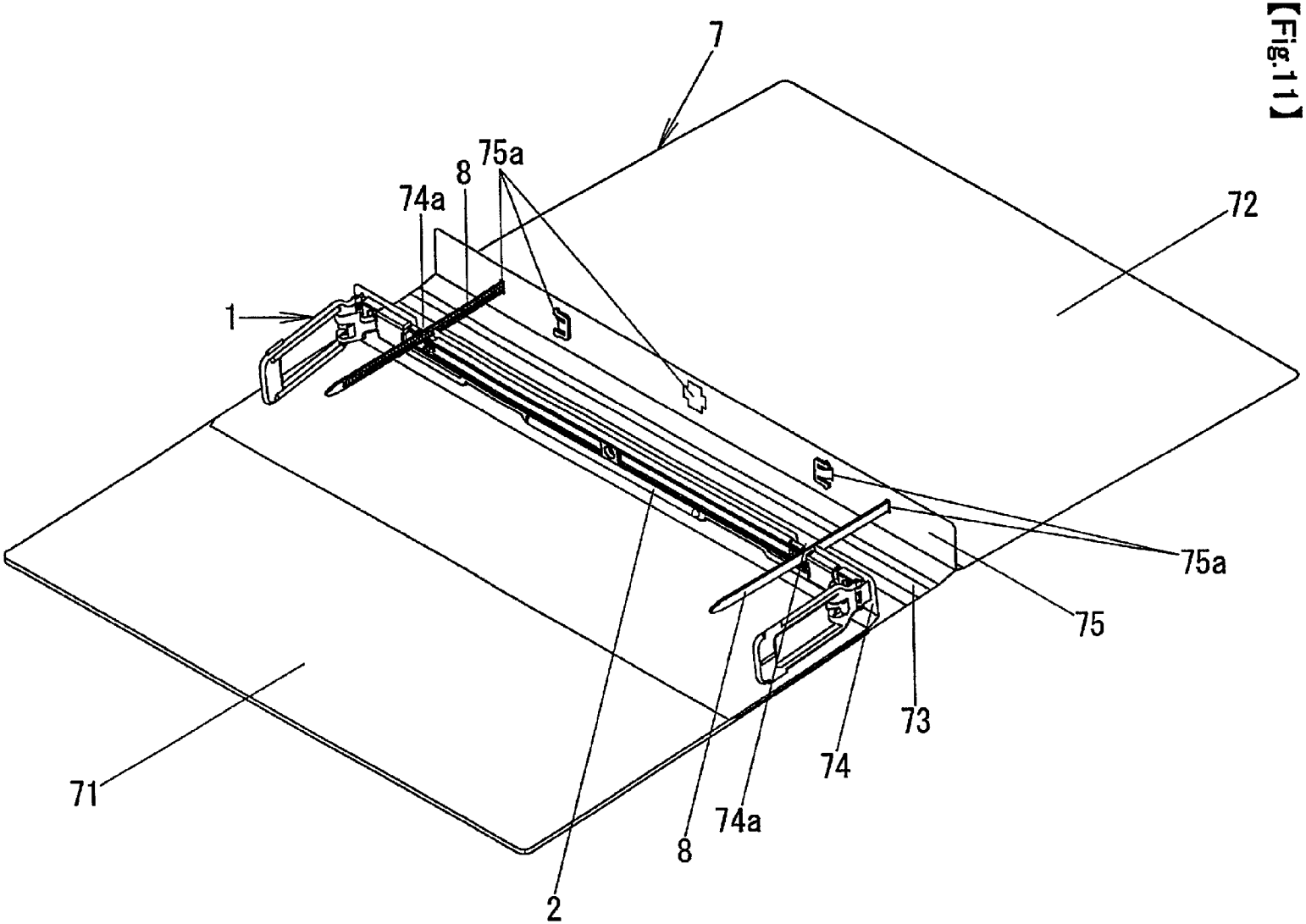

【Fig.12】
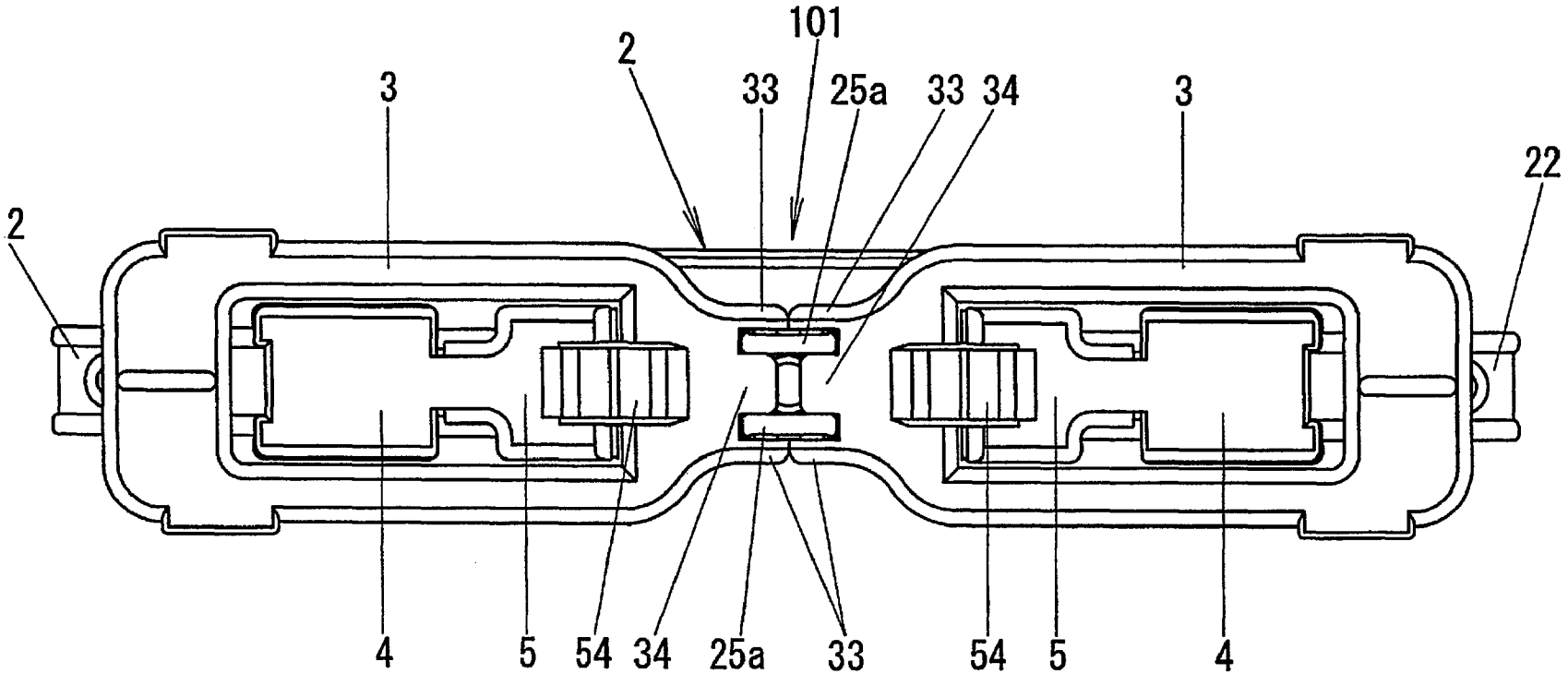

【Fig.13】
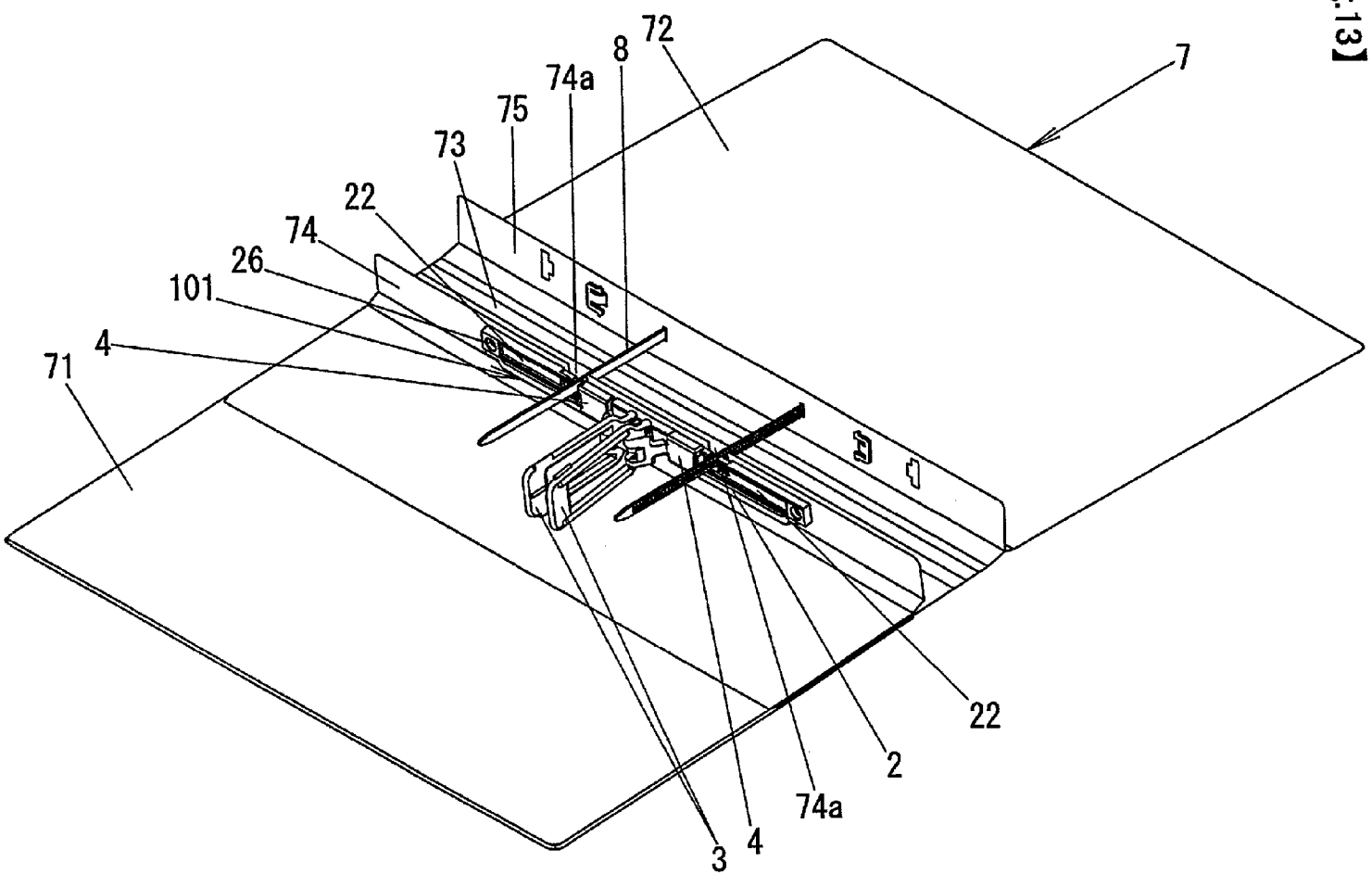

FOLDER BINDING DEVICE

CROSS-REFERENCE TO RELATED APPLICATIONS

This application is based upon and claims the benefit of priority from the prior Japanese Patent Application No. 2007-340512, filed on Dec. 28, 2007; the entire contents of which are incorporated herein by reference.

BACKGROUND OF THE INVENTION

1. Technical Field

The present invention relates to a folder binding device, and more particularly, to a flat folder binding device for use in binding sheets of paper having binding holes formed therein with a pair of binding strips or legs.

2. Background Art

In general, a flat folder for binding sheets of paper having binding holes formed therein is such that binding strips or legs fixed to the folder are inserted and passed through the binding holes in sheets of paper, so that the binding legs are fastened by a binding device. In this flat folder, after the flexible binding legs have been passed through binding holes in sheets of paper, the flexible binding legs are inserted further into holes in a binding device main body, and the binding legs which projects from the binding device main body are then fastened and unfastened by moving horizontally sliding members which are attached slidably to the binding device main body.

In the binding device of this type, since the unfastening and fastening operations are implemented by horizontally moving the sliding members while pressing them, a certain magnitude of force is required. In addition, the unfastening and fastening operations have to be carried out repeatedly every time a sheet or sheets of paper are bound, which is found troublesome to the user. Then, as a binding device which can be operated with slight force without moving sliding members while pressing them, there has been proposed a binding device in which binding legs are fastened and unfastened by a rotary member attached to a binding device main body. Japanese Examined Utility Model Publication No. 57-55105 proposes a binding device which comprises a binding device main body which includes insertion holes through which binding legs are inserted and pressing elements which are rotatably supported on the binding device main body. This proposed binding device is such that the pressing elements open and close binding leg insertion holes to unfasten and fasten the binding legs. In addition, Japanese Unexamined Patent Publication No. 2003-11565 proposes a binding device which comprises a binding device main body having a bearing part and pressing elements having shafts at distal ends of two arms, wherein the pressing elements are mounted rotatably in the bearing part. In this proposed binding device, an inner surface of the bearing part is made into an inclined surface, and the shafts of the pressing elements are also made into inclined surfaces, whereby a supporting construction is provided in which when the arms of the pressing elements return outwards by virtue of elastic force in such a state that the inclined surfaces of the shafts are in surface contact with the inner surface of the bearing part, the pressing elements return to an unfastened angular position by being guided by the inclined surfaces.

SUMMARY OF THE INVENTION

In the mechanisms of the binding devices that have been described above, although the binding legs can easily be fastened by pressing the pressing elements, a locking mechanism has to be provided for locking the pressing element on to the binding device main body so as to keep the binding leg fastened. As such a locking mechanism, a mechanism can be provided in which a locking part and a lock receiving part are formed on a binding device main body and a pressing element, respectively, and by the locking part and the lock receiving part being locked together, the pressing element is locked on to the binding device main body. However, there is caused a problem that a relatively strong operation force is necessary to release the locking mechanism. In addition, there is also caused a problem that the operation is relatively troublesome.

The present invention has been made in view of these situations, and an object thereof is to provide a folder binding device which is easy to operate both in fastening and unfastening binding legs and which can fasten the binding legs in a stable fashion.

According to an aspect of the invention, there is provide a folder binding device comprising a binding device main body part in which insertion holes are formed into which binding legs are inserted, operating parts which are attached to the binding device main body part in such a manner as to rotate on rotating projections at end portions thereof as fulcrums, and sliding parts adapted to slide on the binding device main body part, wherein the sliding parts are connected to the operating parts via hinge parts in such a manner as to be activated by rotary operations of the operating parts to slide on the binding device main body part.

In addition, in the folder binding device of the invention, the hinge part is made up of a main hinge portion which connects the operating part with the sliding part and an auxiliary hinge portion which is provided between the main hinge portion and the operating part, and the auxiliary hinge portion is made to be extended and contracted when the operating part is being rotated.

Furthermore, in the folder binding device of the invention, holding portions are preferably formed on side frame portions of the operating part in such a manner as to project further outwards than the binding device main body part.

In addition, in the folder binding device of the invention, an intermediate projecting portion is preferably provided to prevent the fall of the rotating projections on the operating part from the binding device main body part.

In the folder binding device according to the aspect of the invention that is configured as has been described heretofore, by pushing down or up a distal end portion of the operating part, the sliding part can be caused to slide on the binding device main body part, so as to fasten or unfasten the binding leg which is inserted into the insertion hole in the binding device main body part. In addition, since the operating part is assisted in operation by making use of the extension and contraction of the hinge part, a quick and light operation of the operating part can be attained.

Furthermore, in the folder binding device according to the aspect of the invention, since the holding portions are formed on the side frame portions of the operating part in such a manner as to project further outwards than the binding device main body part, by holding or pinching the holding portions with tips of the fingers or pushing up the holding portions from below, the operating part which falls substantially parallel to the biding device main body part so as to fasten the binding leg can easily be erected so as to release the fastening of the binding leg.

In addition, in the folder binding device according to the aspect of the invention, since the intermediate projecting portion is provided to prevent the fall of the rotating projection of the operating part from the binding device main body part, the fall of the rotating projection from the binding device main body part due to rotary operation of the operating part can be prevented.

BRIEF DESCRIPTION OF THE DRAWINGS

FIG. 1 is an overall perspective view of a folder binding device according to an embodiment of the invention, FIG. 2 is a plan view of the folder binding device according to the embodiment of the invention, FIG. 3 is an enlarged perspective view of a main part of the folder binding device according to the embodiment of the invention, FIG. 4 is an enlarged perspective view of the main part of the folder binding device according to the embodiment of the invention, FIG. 5 is an enlarged perspective view of the main part of the folder binding device according to the embodiment of the invention which is seen from therebelow, and FIG. 6 is a sectional view of a main part of the folder binding device according to the embodiment of the invention. Furthermore, FIG. 7 is an explanatory diagram which explains an operation of the folder binding device according to the embodiment of the invention, FIG. 8 is an explanatory diagram which explains the operation of the folder binding device according to the embodiment of the invention, and FIG. 9 is an explanatory diagram which explains the operation of the folder binding device according to the embodiment of the invention.

FIG. 10 shows explanatory diagrams which explain the operation of the folder binding device according to the embodiment of the invention, FIG. 11 is a perspective view showing a state in which a folder including the folder binding device according to the embodiment of the invention is opened, FIG. 12 is a plan view of a folder binding device according to the other embodiment of the invention, and FIG. 13 is a perspective view showing a state in which a folder including the folder binding device according to the other embodiment of the invention is opened.

DESCRIPTION OF THE PREFERRED EMBODIMENTS

A folder binding device according to an aspect of the invention is made up of a binding device main body part having formed therein insertion holes into which binding strips or legs are inserted and holding grooves for receiving therein the binding legs, operating parts attached to the binding device main body part in such a manner as to rotate on rotating projections at end portions as fulcrums, and sliding parts which are adapted to slide on the binding device main body part, wherein the sliding parts are connected to the operating parts via hinge parts.

In addition, with the rotating projection at the end portion of the operating part acting as a rotating fulcrum, a position lying in the vicinity of the connecting portion between the operating part and the hinge part acting as a point of action, and a movable distal end portion of the operating part acting as a point of application of force, the binding device main body part, the operating parts and the sliding parts are disposed in a positional relationship which realize the rotating fulcrum, the point of action and the point of application of force.

Hereinafter, embodiments of folder binding devices of the invention will be described in detail based on the accompanying drawings. Note that the invention is not limited to embodiments which will be described below at all.

A folder binding device 1 according to an embodiment of the invention is made from a synthetic resin and is, as is shown in FIGS. 1 and 2, made up of a binding device main body part 2, a pair of operating parts 3, and a pair of sliding parts 4. The binding device main body part 2 is formed into a belt-like shape which extends in a longitudinal direction. In addition, the pair of operating parts 3 are attached rotatably to end portions of the binding device main body part 2, respectively. Furthermore, the pair of sliding parts 4 are such as to slide on the binding device main body part 2 and are connected, respectively, to the operating parts 3 which are disposed at the end portions of the binding device main body part 2 via main hinge portions 5.

In addition, as is shown in FIGS. 1 and 2, the binding device main body part 2 is formed into the belt-like shape of a desired thickness, and attaching support parts 25 are provided at the end portions of the binding device main body part 2 for allowing the operating parts 3 to be attached rotatably to the binding device main body part 2. The attaching support part 25 includes two projecting portions 25*a* which projects further upwards than an upper surface of the end portion of the binding device main body part 2. Rotating projection receiving recessed portions (not shown) are formed on outer surface sides of the two projecting portions 25*a* for supporting pivotally rotating projections of the operating part 3, which will be described later. In addition, insertion holes 21 are formed in the binding device main body part 2 in positions lying further longitudinally inwards than the respective attaching support parts 25 so that binding strips or legs are inserted thereinto. These insertion holes 21 are formed by cutting one side portion 2*b* of the binding device main body part 2 vertically relative to the longitudinal direction to a predetermined width. In addition, these insertion holes 21 are formed in positions which substantially coincide with positions on a sheet of paper where insertion holes are opened and positions on a binding flap of a folder to which the folder binding device 1 is attached where binding leg insertion openings are opened. In addition, the other side portion 2*c* of the binding device main body part 2 is formed in such a manner that the width of a lower end portion is expanded so that the folder binding device 1 can be attached to a folder in a stable fashion.

Holding grooves 22 are formed on an upper surface portion 2*a* of the binding device main body part 2 in such a manner as to extend from the positions where the insertion holes 21 are opened to the vicinity of a central portion of the binding device main body part 2. A plurality of locking raised portions 23 are provided in parallel along the longitudinal direction on an upper surface of the holding groove 22 in the vicinity of the insertion hole 21, and these locking raised portions 23 are made to be brought into engagement with recessed portions formed on the binding leg. In addition, as is shown in FIG. 5, a linear guide portion 24 and vertical walls 27 are formed on the side portion 2*b* in which an opening edge of the insertion hole 21 is provided. The guide portion 24 and the vertical walls 27 are defined by a recessed portion which is formed by cutting the side portion 2*b* from a lower end portion to the vicinity of an upper end portion in such a manner as to extend from the position where the opening edge of the insertion hole 21 exists in opposite longitudinal directions towards a center and an end portion of the binding device main body part 2, respectively, to predetermined lengths. In addition, the linear guide portion 24 is formed in such a manner as to extend linearly along the upper surface portion 2*a*. Similarly, vertical walls and a linear guide portion are formed on the other side portion 2*c* by cutting a substantially confronting position from a lower end portion to the vicinity of an upper end portion. In addition, attaching holes 26 are formed substantially in the center and in the vicinity of the end portions of the binding device main body part 2 for use in fastening the folder binding device 1 to a folder.

In addition, provided on the binding device main body part 2 are the operating parts 3, the sliding parts 4 and the hinge parts which are each made up of the main hinge portion 5 and an auxiliary hinge portion 54. Additionally, the pair of operating parts 3, the pair of sliding parts 4 and the pair of hinge parts are disposed symmetrically with each other across a substantially central portion of the binding device main body part 2 as a center of the symmetry as is shown in FIGS. 1 and 2. Consequently, the respective constituent members will be described by taking one of each pair for example.

As is shown in FIGS. 3 and 4, the operating part 3 is a substantially rectangular frame element as viewed from the top which extends in the longitudinal direction of the binding device main body part 2. The operating part 3 is formed wider than the binding device main body part 2, and a substantially rectangular space portion 31 is formed in a central portion thereof. In addition, a longitudinal end of the operating part 3 is made as a proximal end portion, and the proximal end portion is formed narrower than a distal end portion which is the other end of the operating part 3. The operating part 3 includes a pair of rotational base portions 33 and an intermediate projecting portion 34 which is situated between the pair of rotational base portions 33. In addition, two narrow gaps are formed between the pair of rotational base portions 33 and the intermediate projecting portion 34. Rotating projections (not shown) are provided, respectively, on inner surface sides of the respective rotational base portions 33 in such a manner as to intersect the rotational base portion 33 substantially at right angles with their rotational axes disposed substantially on the same straight line, and the rotating projections are made to be brought into engagement with the rotating projection receiving recessed portions of the projecting portions 25*a* which are provided on the attaching support part 25. Furthermore, the narrow gaps are each formed in such a manner that the projecting portion 25*a* can be fitted thereinto, and the operating part 3 is provided on the binding device main body part 2 in such a manner as to rotate about the rotating projection as a fulcrum by the intermediate projecting portion 34 being situated between the projecting portions 25*a* and the rotating projections provided on the respective rotational base portions 33 being brought into engagement with the rotating projection receiving recessed portions of the projecting portions 25*a*.

In the space portion 31 in the operating part 3, a transverse opening width is formed slightly larger than widths of the sliding part 4, which will be described later, and the main hinge portion 5, while a longitudinal opening length is formed longer than a total of lengths of the sliding part 4 and the main hinge portion 5. Consequently, as is shown in FIG. 3, when the operating part 3 is caused to fall to be substantially parallel to the binding device main body part 2 so as to be put in a closed state, the sliding part 4 and the main hinge portion 5 can be fitted in the space portion 31 of the operating part 3. In addition, a substantially rectangular cut-out is provided in a substantially central portion of a proximal end side edge portion of the space portion 31, and the central edge portion of the proximal end side edge portion is made to constitute an auxiliary hinge portion connecting portion 31*b* and edge portions of the proximal end side edge portion which lie on sides of the cut-out portion are each made to constitute a main hinge portion connecting shoulder portions 31*a*. As is shown in FIG. 6, in the main hinge portion connecting shoulder portion 31*a*, a lower edge portion extends further than an upper edge portion, and the lower edge portion is made to constitute a main hinge portion connecting portion 31*c* which connects to the main hinge portion 5.

In addition, holding portions 32 are formed, respectively, on side frame portions of the operating part 3 at a distal end portion thereof. The holding portions 32 are small pieces which project further outwards than the binding device main body part 2, so as to be made easy to be held or pinched by tips of the fingers. Note that a reinforcement member can be formed on an upper surface of a distal end frame portion which lies at the distal end portion of the operating part 3 or on a rear surface of the side frame portion thereof.

As is shown in FIGS. 3 to 5, the sliding part 4 includes a sliding base plate 41 which is formed into a substantially rectangular shape as viewed from the top, side plates 42, front sliding locking portions 45, and rear sliding locking portions 46, so as to form a hollow portion 43 by those constituent portions. The side plates 42 are provided in such a manner as to extend downwards from confronting side portions of the sliding base plate 41. The front sliding locking portion 45 and the rear sliding locking portion 46 are provided in such a manner as to extend from a lower end portion of the side plate 42 substantially parallel to the sliding base plate 41. In addition, the sliding part 4 is provided slidably on the binding device main body part 2 in such a manner as to hold the linear guide portions 24 of the side portions 2*b*, 2*c* of the binding device main body portion 2 by the sliding base plate 41, the front sliding locking portions and the rear sliding locking portion 46.

The sliding base plate 41 is a substantially rectangular thin plate which is elongated in the longitudinal direction of the binding device main body part 2, and a front edge portion which lies on a side facing the center of the binding device main body part 2 is cut out slightly wider than the width of a binding strip or leg 8 so as to form a binding leg guiding portion 44. The main hinge portion 5, which will be described later, is connected to an upper surface of a rear edge portion of the sliding base plate 41 in such a manner as to be valley-foldable.

The front sliding locking portion 45 is provided in a position which is spaced a predetermined interval apart from a front end of the side plate 42, while the rear sliding locking portion 46 is provided at a rear end of the side plate 42. When the sliding part 4 slides towards the center of the binding device main body part 2, the front sliding locking portions 45 come into abutment with the vertical walls 27, whereby the sliding of the sliding part 4 is locked. As this occurs, as is shown in FIG. 3, a state results in which the insertion hole 21 is closed by the sliding part 4. Then, when the sliding part 4 slides towards the end portion of the binding device main body part 2, the rear sliding locking portions 46 come into abutment with the vertical walls 27, whereby the sliding of the sliding part 4 is locked, and as is shown in FIG. 4, a state results in which the insertion hole 21 is opened or exposed.

The hinge part is made up of the main hinge portion 5 and the auxiliary hinge portion 54 and connects the operating part with the sliding part 4. The main hinge portion 5 is a thin member whose proximal end portion is bifurcated and is hence formed into a substantially Y-shape as viewed from the top. The main hinge portion 5 is bifurcated from a trunk portion 53 of a base portion 51 to thereby form a branch portion 52. This main hinge portion 5 is connected to the sliding base plate 41 at a distal end portion of the base portion 51 in such a manner as to be valley-foldable. In addition, as is shown in FIG. 6, at a distal end portion of the branch portion 52, a lower edge portion extends further than an upper edge portion, so as to be connected to the main hinge portion connecting portion 31*c* of the operating part 3 in such a manner as to be mountain-foldable.

In addition, the auxiliary hinge portion 54 is a thin member which is connected to the trunk portion 53 of the main hinge portion 5 and the auxiliary hinge portion connecting portion 31*b* of the operating part 3. In addition, the auxiliary hinge portion 54 is, as is shown in FIG. 6, formed into a substantially M-shape as viewed from the side by a first hinge piece 54*a* which connects to an upper surface of the auxiliary hinge portion connecting portion 31*b* of the operating part 3 from the distal end portion side, a second hinge piece 54*b* which continues to the first hinge piece 54*a* in such a manner as to be mountain-foldable, a third hinge piece 54*c* which continues to the second hinge piece 54*b* in such a manner as to be valley-foldable, and a fourth hinge piece 54*d* which continues to the third hinge piece 54*c* in such a manner as to be mountain-foldable so as to connects an upper surface of the trunk portion 53 of the main hinge portion 5.

The operating part 3, the sliding part 4 and the hinge part are connected to each other through the configurations described above. The operating part 3 is rotatably supported on the binding device main body part 2 at the proximal end portion thereof, while the sliding part 4 is provided slidably on the binding device main body part 2. In addition, since the intermediate projecting portion 34 is provided at the proximal end portion of the operating part 3 and the rotational base portions 33, the projecting portions 25*a* and the intermediate projecting portion 34 are disposed without any gap provided therebetween, the rotating projections of the rotational base portions 33 are brought into engagement with the rotating projection receiving recessed portions of the projecting portions 25*a* in an ensured fashion, whereby the operating part can be made to rotate without falling from the binding device main body part 2.

In addition, in this embodiment, the operating part 3 and the sliding part 4, and the main hinge portion 5 and the auxiliary hinge portion 54 are formed integrally, respectively. The connecting strength of the respective members is maintained by connecting them integrally.

In addition, in the folder binding device 1 of this embodiment, when the operating part 3 is caused to fall to become substantially parallel to the binding device main body part 2, the front sliding locking portions 45 of the sliding part 4 are brought into abutment with the vertical walls 27. In addition, in the folder binding device 1, when the operating part 3 is erected, the rear sliding locking portions 46 of the sliding part 4 are brought into abutment with the vertical walls 27, whereby an outward rotation of the operating part 3 is disabled, and the operating part 3 is left standing substantially vertical relative to the binding device main body part 2. Consequently, the operating part 3 rotates at an angle of about 90 degrees relative to the binding device main body part 2 in such a manner as to rotate from a closed state in which the operating part is caused to fall on the binding device main part 2 to an open state in which the operating part 3 is erected substantially vertically relative to the binding device main body part 2. In addition, in conjunction with the rotating operation of the operating part 3, the sliding part 4 reciprocates horizontally the binding device main body part 2 in such a manner as to open and close the insertion hole 21 formed in the binding device main body part 21.

Namely, as is shown in FIG. 3, in the closed state in which the operating part 3 is caused to fall substantially parallel to the binding device main body part 2, the sliding part 4 is situated in a position which lies at a front end of the linear guide portion 24, that is, in a position which lies closest to the center of the binding device main body part 2, to thereby result in a state in which the insertion hole 21 is closed. In addition, the sliding part 4 and the hinge part fit in the space portion 31 of the operating part 3, and upper surfaces of the respective members come to stay on the same plane. On the other hand, in the open state in which the operating part 3 is erected substantially vertical relative to the binding device main body part 2, as is shown in FIG. 4, the main hinge portion 5 is pulled by the operating part 3 on the branch portion 52 side thereof to thereby be erected, and the sliding part 4 is pulled by the main hinge portion 5 to thereby slide towards the end portion of the binding device main body part 2, whereby the sliding part 4 then comes to be situated in a position which lies closer to the end portion than the insertion hole 21, and a state results in which the insertion hole 21 is opened.

Both in the closed state in which the operating part 3 becomes substantially parallel to the binding device main body part 2 and the open state in which the operating part 3 is erected substantially vertical relative to the binding device main body part 2, the auxiliary hinge portion 54 is in a stable state in which an interval between a mountain-fold portion where the first hinge piece 54*a* continues to the second hinge piece 54*b* (hereinafter, also referred, from time to time, to as a mountain-fold portion at the proximal end portion) and a mountain-fold portion where the third hinge piece 54*c* continues to the fourth hinge piece 54*d* (hereinafter, also referred, from time to tome, to as a mountain-fold portion at the front end portion) becomes shortest. When the operating part 3 is operated to rotate from the closed state to the open state or from the open state to the closed state, the interval between the mountain-fold portions of the auxiliary hinge portion 54 is extended, and in the event that the interval between the fold portions in question exceeds a maximum length position, since the auxiliary hinge portion 54 attempts to return to the stable state, the operation of the operating part 3 is assisted by the auxiliary hinge portion 54.

In the folder binding device 1 of the embodiment, as is shown in FIG. 7, the rotating projection of the operating part 3 is made to act as a rotating fulcrum A, the position lying in the vicinity of the connecting portion between the operating part 3 and the auxiliary hinge portion 54, that is, the mountain-fold portion at the proximal end portion where the first hinge piece 54*a* continues to the second hinge piece 54*b* of the auxiliary hinge portion 54 is made to act as a point of action B, and the distal end portion of the operating part 3 is made to act as a point of application of force C, and the respective constituent members are disposed in such a manner as to realize the positional relationship. In addition, by operating the distal end portion of the operating part 3 which is the point of application of force C, the rotating operation of the operating part 3 is facilitated.

Next, the operation of the folder binding device 1 of the embodiment will be described. As is shown in FIG. 7, when the state results in which the operating part 3 is erected, the sliding part 4 is situated closer to the end portion than the insertion hole 21 of the binding main body part 2, whereby the state results in which the insertion hole 21 is opened. As this occurs, the auxiliary hinge portion 54 is in a stable state in which an interval between the mountain-fold portion at the proximal end portion where the first hinge piece 54*a* continues to the second hinge piece 54*b* and the mountain-fold portion at the front end portion where the third hinge piece 54*c* continues to the fourth hinge 54*d* becomes shortest.

When pushing downwards the distal end portion (the point of application of force C) of the operating part 3 in such a state that a distal end of the binding leg 8 projects from the insertion hole 21 in the binding device main body part 2, as is shown in FIG. 8, the main hinge portion 5 pushes out the sliding part 4 while falling down, whereby the sliding part 4 slides towards the longitudinal center of the binding device main body part 2. When the binding leg 8 is brought into abutment with the binding leg guiding portion 44 of the sliding part 4, the binding leg 8 is pushed by the binding leg guide portion 44 to thereby fall towards the holding groove 22.

When the operating part 3 continues to be pushed downwards, the sliding part 4 slides while holding the binding leg 8 in the hollow portion 43, and the binding leg 8 is caused to fall in the holding groove 22 with recessed portions 81 formed thereon brought into engagement with the locking raised portions 23 formed on the upper surface of the holding groove 22. When the auxiliary hinge portion 54 is extended to its maximum length, a force attempting to return to the stable state is exerted, and the interval between the mountain-fold portion at the proximal end portion and the mountain-fold portion at the front end portion is contracted, whereby the operating part 3 can be pushed downwards without any resistance. Furthermore, when the operating part 3 is pushed downwards until the distal end of the operating part 3 comes into contact with the binding device main body part 2, the operating part 3 becomes substantially parallel to the binding device main body part 2. As this occurs, as is shown in FIG. 9, the binding leg 8 is fastened to the holding groove 22 of the binding device main body part 2, and the main hinge portion 5 also becomes substantially parallel to the binding device main body part 2.

In addition, in this completely closed state, the front sliding locking portions 45 of the sliding art 4 come into abutment with the vertical walls 27 of the binding device main body part 2, and the main hinge portion 5 is put in a state in which the main hinge portion 5 is extended to its maximum length between the sliding part 4 and the rotating projections, whereby the operating part 3 is maintained in the state in which the operating part 3 is substantially parallel to the binding device main body part 2 in a stable fashion. Namely, as is shown in FIG. 10A, the front sliding locking portions 45 of the sliding part 4 come into abutment with the vertical walls 27 of the binding device main body part 2 in a position just before the operating part 3 falls flat completely, and the sliding portion 4 is locked in place. As this occurs, the operating part 3 is not completely level with the sliding part 4 with its distal end spaced slightly apart from the binding device main body part 2.

Then, when the operating part 3 is pushed downwards further at the distal end portion thereof, the main hinge portion connecting portion 31*c* is compressed by the main hinge portion 5 and the proximal end portion of the operating part 3 to thereby be caused to move downwards, and as is shown in FIG. 10B, the main hinge portion connecting portion 31*c* is lowered further downwards than a straight line which connects the connecting portion between the sliding part 4 and the main hinge portion 5 and the rotating fulcrum A, whereby the operating part 3 is stabilized. When put in this stabilized state, the operating part 3 interlocks to fall flat so as to become substantially parallel to the binding device main body part 2, whereby the binding leg 8 can be locked on to the folder binding device 1 in an ensured fashion.

In addition, in the completely closed state in which the binding leg 8 is fastened, as has been described before, the front sliding locking portions 45 are brought into press contact with the vertical walls 27 to thereby put the main hinge portion 5 in the compressed state, whereby the operating part 3 can be maintained in the fallen state, and the binding leg 8 can be kept in the fastened state.

When releasing the fastening of the binding leg 8, an opposite series of operations to the series of operations described above is performed. The operating part 3 which has fallen substantially parallel to the binding device main body part 2 as is shown in FIG. 9 can be erected by hooking the finger around the distal end portion of the operating part 3 to push it upwards with a tip of the finger or pinching the holding portions 32 provided on the side portions of the operating part 3 to pull up the operating part 3. When the operating part 3 is caused to rotate about the rotating projections of the operating part 3 so as to be erected, the main hinge portion 5 erects the branch portion 52 side to cause the sliding part 4 to slide to the end portion of the binding device main body part 2. As this occurs, the interval between the mountain-fold portion at the proximal end portion and the mountain-fold portion at the distal end portion of the auxiliary hinge portion 54 is extended gradually, and when the interval is extended to its maximum length, the auxiliary hinge portion 54 contracts in an attempt to return to the stable state. Because of this, a quick and light operating part erecting operation can be realized in which a feeling of resistance is given in an intermediate position in the process of erecting the operating part 3, while a feeling of lightness is given in the open position and the closed position. In addition, when the operating part 3 is erected at the angle of about 90 degrees relative to the binding device main body part 2, the sliding part 4 opens the insertion hole 21 as is shown in FIG. 7, whereby the binding leg 8 is allowed to be removed from or inserted into the through hole 21.

As is shown in FIG. 11, the folder binding device 1 of the embodiment is fixed to a folder 7 for use. The folder 7 to which the folder binding device 1 of the invention is applied is made up of a front cover 71, a rear cover 72, a spine 73, and binding flaps 74, 75. The front cover 71 and the rear cover 72 are formed into a rectangular shape whose size is made to match the standards of metric paper sizes such as A4, B5. In addition, the binding flaps 74, 75 are formed on binding sides of the front cover 71 and the rear cover 72 into a strip-like rectangular piece which extends longitudinally from an upper end to a lower end of the cover.

The binding device main body part 2 of the folder binding device 1 is fixed to the binding flap 74 of the front cover 71 from a side facing the front cover 71 by fastening the former to the latter with fastening elements put through the attaching holes 26 in such a manner that the through holes 21 in the binding device main body part 2 coincide with binding leg insertion openings 74*a* in the binding flap 74. Then, on the folder 7, the binding legs 8 are fixed to the binding flap 75 of the rear cover 72 and are inserted into the binding leg insertion openings 74*a* in the binding flap 74 of the front cover 71 from the open side with distal ends of the binding legs 8 made to project from the binding device main body part 2 of the folder binding device 1, whereby the binding legs 8 are fastened by rotating the operating parts 3 of the folder binding device 1.

In addition, another embodiment of a folder binding device is shown in FIG. 12. As is shown in FIG. 12, there may be provided a folder binding device 101 in which attaching support portions for attaching operating parts 3 are formed in a center of a binding device main body part 2 which is formed into a strip-like shape which extends in a longitudinal direction. In this folder binding device 101, two longitudinally parallel projecting portions 25*a* are provided substantially in the center of the binding device main body part 2 in such a manner as to project from an upper surface of the binding device main body part 2. Two rotating projection receiving recessed portions are provided in parallel in the longitudinal direction on an external side of each projecting portion 25*a*. In addition, the rotating projection receiving recessed portions are made to be brought into engagement with corresponding rotating projections which are provided rotational base portions 33 of operating parts 3. Additionally, insertion holes into which binding legs can be inserted are formed in positions lying longitudinally closer to respective end portions of the binding device main body part 2 than the mounting support portions 25 by cutting the binding device main body part 2 from one side portion thereof to form substantially rectangular-shaped openings.

Holding grooves 22 for receiving the binding legs are formed on an upper surface portion of the binding device main body part 2 in such a manner as to extend from both the insertion holes towards the respective end portions of the binding device main body part 2, and locking raised portions are provided in parallel in the longitudinal direction on upper surfaces of the holding grooves 22 in positions lying in the vicinity of the insertion holes in such a manner as to be brought into engagement with recessed portions formed on the respective binding legs. A linear guide portion and vertical walls are formed on the side portion in which an opening edge of the insertion hole is provided. The guide portion and the vertical walls are defined by a recessed portion which is formed by cutting the side portion from a lower end portion to the vicinity of an upper end portion in such a manner as to extend from the position where the opening edge of the insertion hole exists in opposite longitudinal directions towards a center and the end portion of the binding device main body part 2, respectively, to predetermined lengths. In addition, the linear guide portion is formed in such a manner as to extend linearly along the upper surface portion. Similarly, vertical walls and a linear guide portion are formed on the other side portion by cutting a substantially confronting position from a lower end portion to the vicinity of an upper end portion.

The operating part 3 is pivotally provided on the binding device main body part 2 by bringing the rotating projections on the rotational base portion 33 formed at the proximal end portion of the operating part 3 into engagement with the rotating projection receiving recessed portions formed the projecting portions 25*a* of the attaching support part and in such a manner that a sliding part 4 connected to the operating part 3 is provided in such a way as to hold the linear guide portions. This folder binding device 101 is configured in such a manner that the operating parts 3 individually rotate outwards, and the sliding parts 4 are individually made to shift from the center towards the respective end portions of the binding device main body part 2 so as to close the through holes.

The folder binding device 101 of this embodiment is, as is shown in FIG. 13, fixed to a binding flap 74 of a front cover from a side facing the front cover 71 by fastening the former to the latter with fastening elements put through attaching holes 26 in such a manner that the through holes in the binding device main body part 2 coincide with binding leg insertion openings 74*a* in the binding flap 74. Since the insertion holes are made to be positioned close to the center of the folder, the folder binding device 101 can suitably be applied to a general two-hole folder.

Note that in the embodiment, while the through holes 21 in the binding device main body part 2 are described as being formed as the holes which are opened in the side portion 2*b* of the binding device main body part 2, the through holes 21 may be formed in the binding device main body part 2 as through holes surrounded on their peripheries.

In addition, a plurality of auxiliary hinge portions 54 can be provided. For example, the branch portion 52 of the main hinge portion 5 is formed narrower than the base portion 51 and is provided substantially in the center of the trunk portion 53, so that auxiliary hinge portions 54 may be provided on both sides of the branch portion 52.

Furthermore, in the event that the binding device main body part 2 is configured in such a manner that a locking piece is provided on the side portion 2*b* in which the through holes 21 are formed in such a manner as to be mountain-foldable relative to the binding device main body part 2 so that the binding device main body part 2 and the locking piece lock each other in such a state that the binding flap 74 of the front cover 71 is held by the binding device main body part 2 and the locking piece therebetween, the binding device main body part 2 can be made detachable from the folder, whereby the reuse and fractionating disposal of the binding device main body 2 can be enabled.

What is claimed is:

1. A folder binding device comprising:

a binding device main body part having insertion holes as passages for inserting two binding legs used to bind a folder;

two sliding parts adapted to individually slide on the binding device main body part; and two operating parts respectively having rotating projections at respective end portions thereof and being individually connected to the sliding parts via hinge parts, wherein:

the two operating parts are attached to the binding device main body part in such a manner as to rotate about the rotating projections as fulcrums;

rotating axes of the rotating projections are disposed in a direction which intersects with a longitudinal direction of the binding device main body part and the two operating parts have individual frame elements having space portions in which the sliding parts are capable of being accommodated so as to be fitted, wherein each sliding is activated in association with rotary operations of the operating parts via the hinge parts to slide on the binding device main body part.

2. A folder binding device as set forth in claim 1, wherein the hinge parts are individually made up of main hinge portions and auxiliary hinge portions, wherein the main hinge portions individually connect the operating parts with the sliding parts, wherein the auxiliary hinge portions are individually provided between the main hinge portions and the operating parts, and wherein the auxiliary hinge portions are made to be extended and contracted when the operating parts are being rotated.

3. A folder binding device as set forth in claim 1, wherein the frame elements of operating parts individually have side frame portions on which holding portions are formed in such a manner as to project further outwards than the binding device main body part.

4. A folder binding device as set forth in claim 2, wherein the frame elements of operating parts individually have side frame portions on which holding portions are formed in such a manner as to project further outwards than the binding device main body part.

5. A folder binding device as set forth in claim 1, wherein an intermediate projecting portion is provided to prevent the fall of the rotating projections on the operating part from the binding device main body part.

6. A folder binding device as set forth in claim 2, wherein an intermediate projecting portion is provided to prevent the fall of the rotating projections on the operating part from the binding device main body part.

7. A folder binding device as set forth in claim 3, wherein an intermediate projecting portion is provided to prevent the fall of the rotating projections on the operating part from the binding device main body part.

8. A folder binding device as set forth in claim 4, wherein an intermediate projecting portion is provided to prevent the fall of the rotating projections on the operating part from the binding device main body part.

* * * * *